US010920587B2

(12) United States Patent
Yuratich et al.

(10) Patent No.: US 10,920,587 B2
(45) Date of Patent: Feb. 16, 2021

(54) FORMATION EVALUATION PUMPING SYSTEM AND METHOD

(71) Applicant: Fiorentini USA Inc, Wheeling, WV (US)

(72) Inventors: Michael Yuratich, Hamble (GB); Philip Powell, New Alresford (GB)

(73) Assignee: Fiorentini USA Inc, Wheeling, WV (US)

( * ) Notice: Subject to any disclaimer, the term of this patent is extended or adjusted under 35 U.S.C. 154(b) by 76 days.

(21) Appl. No.: 16/426,677

(22) Filed: May 30, 2019

(65) Prior Publication Data

US 2019/0368351 A1 Dec. 5, 2019

Related U.S. Application Data

(60) Provisional application No. 62/678,500, filed on May 31, 2018.

(51) Int. Cl.

| | |
|---|---|
| ***E21B 49/08*** | (2006.01) |
| ***E21B 49/10*** | (2006.01) |
| ***E21B 49/00*** | (2006.01) |

(52) U.S. Cl.

CPC ..... *E21B 49/082* (2013.01); *E21B 49/008* (2013.01); *E21B 49/088* (2013.01); *E21B 49/10* (2013.01); *E21B 49/0875* (2020.05)

(58) Field of Classification Search

CPC ..... E21B 49/08; E21B 49/081; E21B 49/082; E21B 49/0813; E21B 49/0815; E21B 49/087; E21B 49/088; E21B 49/10; F04B 9/1235; F04B 9/131; F04B 9/137; F04B 9/1374; F04B 9/1376

See application file for complete search history.

(56) References Cited

U.S. PATENT DOCUMENTS

| | | | | |
|---|---|---|---|---|
| 3,611,799 A | | 10/1971 | Davis | |
| 4,178,240 A | * | 12/1979 | Pinkerton | A61M 1/16 137/99 |
| 4,507,957 A | * | 4/1985 | Montgomery | E21B 49/10 166/100 |
| 4,591,320 A | | 5/1986 | Pope | |
| 4,676,096 A | | 6/1987 | Bardsley et al. | |
| 4,753,532 A | | 6/1988 | Aldred | |
| 4,860,581 A | | 8/1989 | Zimmerman et al. | |
| 5,303,775 A | | 4/1994 | Michaels et al. | |
| 5,377,755 A | | 1/1995 | Michaels et al. | |

(Continued)

FOREIGN PATENT DOCUMENTS

WO WO-2018204211 A1 * 11/2018 ..... G01N 1/10

*Primary Examiner* — Jennifer H Gay

(74) *Attorney, Agent, or Firm* — Matthew J Patterson

(57) ABSTRACT

A double piston positive displacement pumping system and methods are disclosed. The pump has a working bore with a first piston defining a pair of working chambers and a separate pumping bore having a second piston defining a pair of pumping chambers. The pistons are coupled together by a connecting rod such that the translate together axially within their respective bore. Working fluid is controllably introduced into and out of the working chambers to force the axial translation of the piston pair and wherein a process fluid is drawn into and out of the pumping chambers. The working fluid and the process fluid are confined to their respective bores and pistons.

7 Claims, 6 Drawing Sheets

(56) References Cited

U.S. PATENT DOCUMENTS 5,473,939 A * 12/1995 Leder ..... E21B 23/06 166/264
5,564,912 A * 10/1996 Peck ..... F04B 9/113 417/396
6,301,959 B1 * 10/2001 Hrametz ..... E21B 49/10 73/152.23
6,478,552 B1 * 11/2002 Batten ..... F04B 9/107 417/393
6,907,797 B2 * 6/2005 DiFoggio ..... E21B 49/081 166/100
7,124,819 B2 * 10/2006 Ciglenec ..... E21B 49/081 166/264
7,302,966 B2 * 12/2007 Brennan, III ..... E21B 49/081 137/270
7,527,070 B2 * 5/2009 Brennan, III ..... E21B 49/081 137/270
7,878,244 B2 * 2/2011 Nold, III ..... E21B 49/10 166/264
7,984,756 B2 * 7/2011 Dowling ..... F04B 47/022 166/68
8,323,003 B2 * 12/2012 Judge ..... F04B 9/1235 417/404
8,348,642 B2 * 1/2013 Brennan ..... F04B 47/08 417/437
8,613,313 B2 12/2013 Ziauddin et al.
8,613,317 B2 * 12/2013 Briquet ..... F04B 47/08 166/264
9,091,150 B2 7/2015 Ross et al.
9,399,913 B2 7/2016 Murphy et al.
10,227,970 B2 * 3/2019 Gisolf ..... E21B 47/008
10,539,015 B2 * 1/2020 Nguyen-Thuyet ..... E21B 49/10
2004/0089448 A1 * 5/2004 DiFoggio ..... E21B 49/081 166/264
2005/0115716 A1 * 6/2005 Ciglenec ..... E21B 49/081 166/373
2006/0099093 A1 * 5/2006 Brennan, III ..... F04B 47/08 417/423.3
2006/0204375 A1 * 9/2006 Judge ..... F04B 9/1376 417/393
2008/0053212 A1 * 3/2008 Brennan, III ..... F04B 53/10 73/152.26
2008/0245569 A1 * 10/2008 Nold ..... E21B 49/10 175/24
2009/0260798 A1 * 10/2009 Brennan, III ..... E21B 49/081 166/66.6
2011/0100641 A1 * 5/2011 Briquet ..... E21B 33/1275 166/373
2012/0152533 A1 * 6/2012 Hoefel ..... E21B 49/088 166/264
2013/0081803 A1 * 4/2013 Tao ..... E21B 17/1014 166/247
2015/0354329 A1 12/2015 Perry et al.
2016/0177714 A1 * 6/2016 Tao ..... F04B 53/14 166/53
2016/0177942 A1 * 6/2016 Tao ..... F04B 51/00 417/53
2017/0074095 A1 * 3/2017 Nguyen-Thuyet ..... E21B 34/06
2017/0363077 A1 * 12/2017 Gisolf ..... F04B 49/065
2019/0368351 A1 * 12/2019 Yuratich ..... E21B 49/088
2020/0003054 A1 * 1/2020 Yuratich ..... E21B 49/10
2020/0182750 A1 * 6/2020 Yuratich ..... G01N 1/2035

* cited by examiner

FORMATION EVALUATION PUMPING SYSTEM AND METHOD

CROSS REFERENCE TO RELATED APPLICATIONS

This application claims the benefit of U.S. Provisional Patent Application Ser. No. 62/678,500 filed 31 May 2018. The disclosure of the application above is incorporated herein by reference in its entirety.

BACKGROUND OF THE INVENTION

Field of the Invention

Embodiments of the invention generally relate to tools and techniques for performing formation testing and, more particularly, to pumping systems and methods for evaluating formations.

Description of the Related Art

Wireline formation testing tools are well known in the prior art in providing permeability, mobility, sampling and other information that can be inferenced therefrom about the reservoir. It is known that companies involved in the production of hydrocarbons strive to produce as much of the reserves within any given formation as possible using any enhanced oil or gas recovery methods as known in prior art. Hydrocarbon bearing formations that are either "tight" or aging sometimes need to be stimulated in order to enhance the recovery of the hydrocarbons.

During the drilling operation, and prior to production, it is desirable to obtain information about the formation through which the wellbore is traversing. It is typical within the industry to use tools equipped with various sensors to perform testing to obtain such information either while drilling using logging while drilling (LWD) tools or wireline tools. Such information includes permeability, mobility, pressure, temperature and the like. The information gathered is important to permit accurate assessment of the production capacity a formation.

Common among the LWD and wireline techniques for measuring formation and reservoir fluid properties is the ability to take measurements of the formation and reservoir fluids at predetermined depths along the wellbore. Known tools typically include a probe that can penetrate the wellbore wall and establish fluid communication with reservoir fluids within the formation. A typical probe assembly includes a seal, or packer, to seal against the mudcake and establish fluid communication with the reservoir. A short pretest module with a piston pump establishes whether sealing has occurred and communication has been established. After which a main pump can be employed to perform other tests. Note that the probe may not penetrate the wellbore wall in order to seal and remove the mudcake and establish communication. The packer is pressed against the wellbore wall by pressure and the backup shoes and this is good enough for formations that are not penetrable. The mudcake can be removed from the formation by the pretest and then the main pump may clean out the flowline and further clean out the probe. The main pump within the tool can be hydraulically connected to the probe and is typically controlled to perform various fluid tests, pump out (or clean-up) procedures, injection of fluids, pressurizing inflatable packers and sampling procedures among other things. In addition, the main pump can be configured to perform other operations, such as to purge invasion filtrate from the probe or a packer, cleaning or unblock the flow line and probe, energize a compression-set packer mechanism, transfer fluid to sample cylinders.

It is an important aspect of any downhole tool for formation testing that the pump has the capability to perform the above listed tasks in a controlled manner. There exist many pumps and pumping systems in the prior art and are described, for example, in U.S. Pat. Nos. 3,611,799, 4,753,532, GB2172631, U.S. Pat. Nos. 4,860,581, 7,527,070 and 8,613,313, which are incorporated herein by reference in their entirety. Many of the pumps in the prior art are operated using hydraulic fluid provided by a driving pump. In order to provide the requisite pumping volumes and pressures within the confines of a downhole tool many prior art pumps include so called "dual piston" pumps such as those described, for example, in U.S. Pat. Nos. 4,676,096, 5,303,775, and 5,377,755, which are incorporated herein by reference in their entirety. Other import aspects of downhole pump design include exposure to harsh environmental conditions such as $H_2S$ absorption in oil film, $H_2S$ adsorption or trapping of solid materials used in pump construction, and their effects on reliability, maintenance, and the cost of the pump. One common feature of the aforementioned piston pumps of the prior art is that they introduce working fluids and process fluids into common pumping chambers and pistons. This feature exposes all of the various parts of the pump to the above mentioned harsh environmental conditions adversely affecting reliability, maintenance, and the lifetime cost of the pump. $H_2S$ absorption in oil films within the pump may also reduce the ability to make accurate measurement of $H_2S$ with sensors in the tool string 20. It is important for such testing tools to have the ability to obtain a sample that is representative of any $H_2S$ and other chemicals that would be in the production fluid of the reservoir. The accuracy of such representative samples is also extremely important for facilities (pipelines, transportation, and refineries) design and preparation for receiving the fluids produced from the well. Main pumps which include seals and involve cavitation cause major scavenging of chemicals and minerals within the formation fluid sample. This is especially important because the sample cylinders are normally located on the downstream of the pump and therefore collect fluids that may not be representative of the fluids in the formation. Indeed, the pumps can cause breakout of the fluids from the mixture and can result in changing the fluid mixture composition of the flow line fluids that have been carefully removed from the formation and therefor can differ from the information gathered by sensors used to analyze the fluids. In this way, the main pump can make the sample to be not representative of the fluids within the formation. In addition, it is known that fluids may be changed within the flow lines and even within the formation if the system does not adequately control the flow rates and the pressure within the tool, flowlines, and formation.

There exists a need for a controllable downhole pumping system for a formation tester that provides sufficient volume and pressure while maintaining formation pressure and overcomes the problems in the prior art.

SUMMARY OF THE INVENTION

One general aspect includes a fluid pumping system that includes a housing having a first cylinder and a second cylinder in axial alignment positioned therein, a working piston slidably positioned in the first cylinder and a pumping piston slidably positioned in the second cylinder and a connecting rod axially connecting the working piston to the pumping piston and sealably isolating the first cylinder from the second cylinder, where the working piston forms a first working chamber and a second working chamber in the first cylinder and where the pumping piston forms a first pumping chamber and a second pumping chamber in the second cylinder.

Implementations may include one or more of the following features. The fluid pumping system where the first working chamber and the second working chamber are configured to be in fluid communication with a working fluid and the first pumping chamber the second pumping chamber are configured to be in fluid communication with a process fluid. The fluid pumping system further includes a first working port positioned in the first working chamber configured to be in fluid communication with the working fluid and a second working port positioned in the second working chamber configured to be in fluid communication with the working fluid and a first pumping port positioned in the first pumping chamber configured to be in fluid communication with the process fluid, and a second pumping port positioned in the second pumping chamber configured to be in fluid communication with the process fluid. The fluid pumping system further including a first working valve positioned in the first working port, a second working valve positioned in the second working port, a first pumping valve positioned in the first pumping port and a second pumping valve positioned in the second pumping port. The fluid pumping system further includes a working piston seal positioned on an outer diameter of the working piston to fluidically seal the first working chamber from the second working chamber and a pumping piston seal positioned on an outer diameter of the pumping piston to fluidically seal the first pumping chamber from the second pumping chamber. The fluid pumping system further including a displacement rod connected to the working piston and slidably sealing the first working chamber from an outside portion of the first cylinder. The fluid pumping system where the outer diameter of the working piston is larger than the outer diameter of the pumping piston. The fluid pumping system where the outer diameter of the working piston is essentially equal to the outer diameter of the pumping piston. The fluid pumping system further including a hydraulic pumping module coupled to the first working valve and configured to selectively pump the working fluid into and out the first working chamber and coupled to the second working valve and configured to selectively pump the working fluid into and out of the second working chamber. The fluid pumping system further includes a first valve module coupled to the first pumping valve and configured to selectively allow the process fluid into and out of the first pumping valve, and a second valve module coupled to the second pumping valve and configured to selectively allow the process fluid into and out of the second pumping valve. The fluid pumping system where the hydraulic pumping module includes a working fluid tank; a motor; a hydraulic pump coupled to the motor and in fluid communication with the working fluid tank; and a hydraulic pumping module shuttle valve selectively fluidically coupled to the working fluid tank, the pump, the first working valve and the second working valve. The fluid pumping system where the first valve module includes a first valve module port; a second valve module port; a third valve module port; and a first valve module shuttle valve selectively fluidically coupled to the first valve module port, the second valve module port, the third valve module port and the first pumping port; the second valve module includes: a fourth valve module port; a fifth valve module port; a sixth valve module port and a second valve module shuttle valve selectively fluidically coupled to the fourth valve module port, the fifth valve module port, the sixth valve module port and the first pumping port the second valve module port is fluidically coupled to the fourth valve module port; and the third valve module port is fluidically coupled to the fifth valve module port. The fluid pumping system where the working fluid includes any of a mineral oil, a drilling mud, and a water. The fluid pumping system where the process fluid includes any of a drilling mud, a filtrate, a reservoir fluid, and an injection fluid.

One general aspect includes a method of pumping a fluid in a wellbore including positioning a pump at a downhole position in the wellbore, the pump includes a housing having a first cylinder and a second cylinder in axial alignment positioned therein; a working piston slidably positioned in the first cylinder and a pumping piston slidably positioned in the second cylinder, a connecting rod axially connecting the working piston to the pumping piston and sealably isolating the first cylinder from the second cylinder where the working piston forms a first working chamber and a second working chamber in the first cylinder and where the pumping piston forms a first pumping chamber and a second pumping chamber in the second cylinder and operating the pump to move the fluid into and out of the first pumping chamber and the second pumping chamber.

Implementations may include one or more of the following features. The method where the step of operating the pump includes pumping a working fluid into the first working chamber, translating the working piston and the pumping piston in a forward stroke direction, exhausting the working fluid out of the second working chamber, drawing the fluid into the first pumping chamber, and exhausting the fluid out of the second pumping chamber. The method where the step of operating the pump further includes pumping the working fluid into the second working chamber, translating the working piston and the pumping piston in a return stroke direction, exhausting the working fluid out of the first working chamber, drawing the fluid into the second pumping chamber, and exhausting the fluid out of the first pumping chamber. The method where the steps of exhausting the fluid include any of exhausting the fluid in an uphole direction and exhausting the fluid in a downhole direction.

Another general aspect includes a pump having a housing having a first end wall and a second end wall and a separating member positioned therebetween, where a first cylinder is defined by the first end wall and the separating member and a second cylinder is defined by the second end wall and the separating member, the first cylinder having a first piston slidably positioned therein and the second cylinder having a second piston slidably positioned therein, a connecting rod coupling the first piston to the second piston and sealably passing through the separating member, a first working chamber formed between the first piston and the first end wall and a second working chamber formed between the first piston and the separating member; and a first pumping chamber formed between the second piston and the separating member and a second pumping chamber formed between the second piston and the second end wall.

Implementations may include one or more of the following features. The pump where the first working chamber and the second working chamber are configured to receive a working fluid and the first pumping chamber and the second pumping chamber are configured to receive a process fluid. The pump where the working fluid forces the first piston and the second piston to translate in a forward stroke direction and a return stroke direction, the process fluid is drawn into the first pumping chamber and exhausted out of the second pumping chamber in the forward stroke direction, and the process fluid is drawn into the second pumping chamber and exhausted out of the first pumping chamber in the return stroke direction.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention can comprise a pumping system for a formation dynamic testing (FDT) tool which includes a probe for accessing the formation fluids and a sample collection system, and can further include straddle packers for the isolation of zones in the formation.

Figure 1:
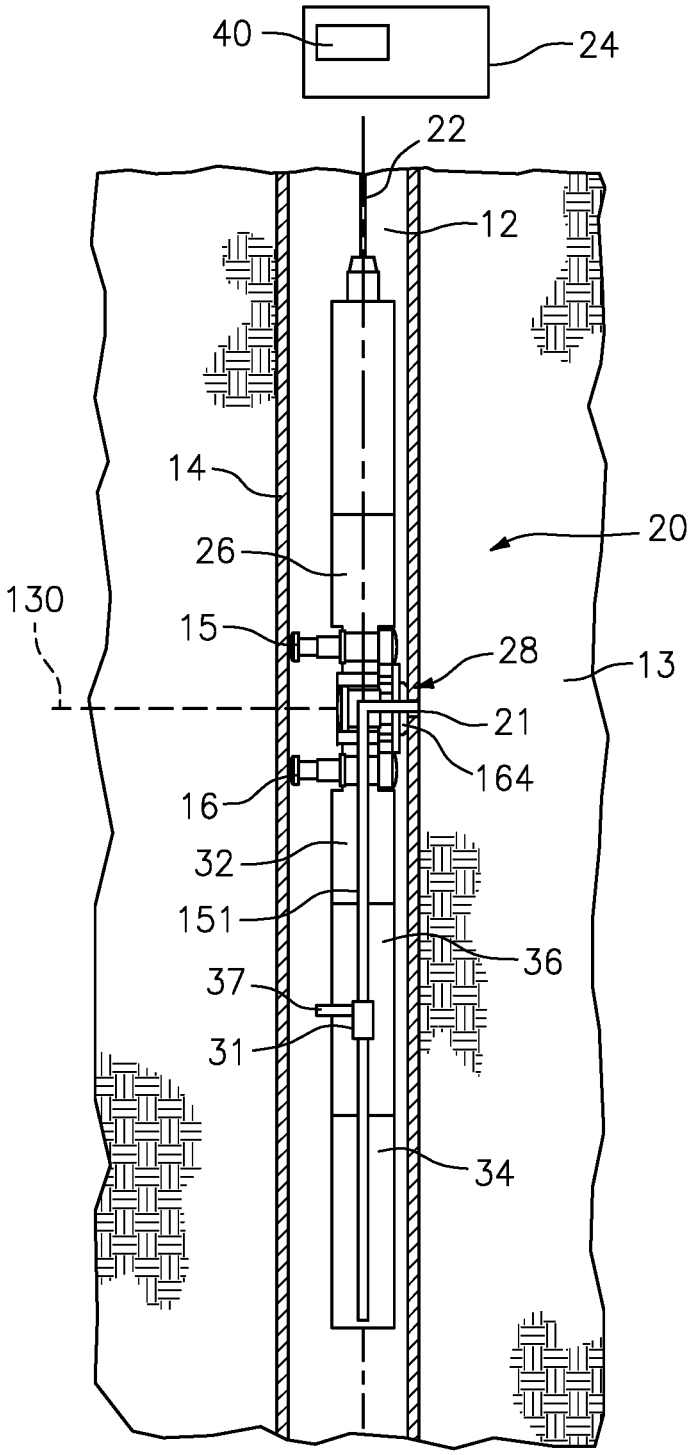
FIG. 1 is a schematic representation of an exemplary formation tester for analyzing downhole formation fluids in accordance with certain aspects of the present disclosure.

With reference to FIG. 1, there is shown an embodiment of a wireline formation tester 20 deployed within a well 12 drilled into formation 13. In operation, wireline formation tester 20 can be deployed into well 12 via multi-conductor cable 22 over a pulley (not shown). As is well known in the art, multi-conductor cable 22 includes electrical conductors for powering the tool, data communications conductors as well as tensile members for supporting the weight of the testing tool. The borehole typically contains various mixtures of fluids and gasses wherein the mixture varies by depth, age of the well and various other factors. The well is shown as an open hole however, the present invention is not limited to open hole wells and could, for instance, be used within a cased hole well.

Still referring to FIG. 1, an embodiment of a formation tester 20 of the present invention is shown wherein the tool is deployed in well 12 and includes various modules as will be described in more detail herein below. The multi-conductor cable 22 caries electrical power and data to and from and power and processing unit 24 located at the surface. The power and processing unit includes the capability to control the various modules included in the tool string 20. In addition, power and processing unit 24 includes a processor 40, in the form of a computer and the like, for processing the electrical signals from the tool into information concerning the analysis and characterization of the downhole fluids as well as any known storage medium. In this particular embodiment, the formation tester 20 includes a clamping mechanism comprised of shoes 15, 16 that are urged against the borehole wall 14 by pistons to stabilize the formation tester within the wellbore 12. The formation tester 20 includes a probe assembly 28 having a mechanism to urge the probe pad against borehole wall 14 with sufficient force to releasably fix the formation tester in place at preselected test position 130. The probe assembly 28 and shoes 15, 16 are configured to establish a planar position so that the formation tool does not rotate or wobble in the preselected downhole position 130. The probe pad 164 further seals the formation 13 from the wellbore 12 in the area of contact with borehole wall 14. The probe pad 164 of probe assembly 28 contacts the borehole wall 14 and any mudcake that may exist adjacent thereto and enters into hydraulic communication with the formation 13. The probe pad 164 is in hydraulic communication with pumping module 31 via flowline 151 wherein the pumping module 31 is shown mounted within pump out module 36 mounted within the formation tester housing 26 wherein the flowline 151 presents reservoir fluid to a testing module 32, such as an optical fluid analyzer (OFA), for monitoring and analysis of reservoir fluids and can further pump the fluids into the wellbore 12 via conduit 37. Although the order of testing module 32 and modules 34, 36 are as shown, it is within the scope of the present disclosure that the modules may be mounted within other modules and in other configurations, such as above or below the probe assembly 28. The probe pad 164 may also include a guard ring (not shown) and which may comprise a loop that encircles the ring and is hydraulically coupled to pumping module 31. An exemplary embodiment of a focused guard probe is disclosed in U.S. Pat. No. 6,301,959 ('959) to Hrametz. Pumping module 31 moves fluids from formation 13 through the tool and testing module 32 for analysis as will be more fully explained herein below.

Pumping module 31 includes a positive displacement pump 50 in accordance with an embodiment of the present disclosure as best described with reference to FIG. 2. The embodiment of pump 50 of the present disclosure is a positive displacement, dual piston, linear tandem pump. Pump 50 includes a working housing 51 and a pumping housing 52 wherein the working housing defines a working bore 53 and the pumping housing defines pumping bore 54 and wherein the housings 51, 52 are connected in axial alignment either directly to each other or each is affixed to connecting member, 55. Pump 50 further includes a working piston 56 and a pumping piston 57 fixedly mounted to a connecting rod 58, a portion of which passes substantially through the center of housings 51, 52. Connecting rod 58 is connected to the centers of working piston 56 and pumping piston 57 thereby ensuring their axial alignment. A displacement rod 70 is also mounted to piston 56 and translates inside of housing 51 and to an outside portion of the housing. Working piston 56 is slidably fluidically sealed against the inner wall of working bore 53 by a working piston seal, for example, o-rings (not shown) positioned on the outer diameter of the working piston, and further defines the working bore into two variable volume chambers 59, 60. Pumping piston 57 is slidably fluidically sealed against the inner wall of pumping bore 54 by a pumping piston seal, for example, o-rings (not shown) positioned on the outer diameter of the pumping piston, and further defines the pumping bore into two variable volume chambers 61, 62. Connecting rod 58 is slidably sealed against the end walls of working housing 51 and pumping housing 52 by, for example, o-rings (not shown), sealing the bores from each other and from the exterior of the housings. As will be more fully described herein below, a working fluid is controllably introduced into and out of first working chamber 59 via first working port 64 and into and out of second working chamber 60 via second working port 65 to produce a pressure differential on either side of working piston 56 to translate connecting rod 58 axially, in the direction indicated by arrow 63, moving working piston 56 and pumping piston 57 in the same direction and causing the volumes of chambers 59, 60, 61, 62 to change in a proportional manner. The first working port 64 and the second working port 65 may include a first working valve and a second working valve respectively (not shown). The working fluid (not shown) can comprise any low compressibility fluid such as mineral oil, drilling mud, water, and the like. As piston 57 translates axially in the direction of arrow 63, pumping fluids, or process fluids, (not shown) are controllably introduced into and out of first pumping chamber 61 via first pumping port 66 and into and out of second pumping chamber 62 via port 69. In the embodiment shown, the pumping fluids can comprise drilling mud, filtrate, reservoir fluids, injection fluids and the like. The first pumping port 66 and the second pumping port 69 may include a first pumping valve and a second pumping valve respectively (not shown). Although bores 53, 54 are shown in this embodiment with two ports each, it should be appreciated by those skilled in the art that a different number of ports could be used with various arrangements of valves as will be discussed herein below. In addition, although the pistons 56, 57 and bores 53, 54 are shown as approximately the same size, their relative size may advantageously be different to provide different operating characteristics of the pump without departing from the scope of the present disclosure.

As discussed herein before, it is known in the art that such prior art pumps can be controlled and it is a further advantage to control the pump in a manner that provides for a constant volumetric flow rate Q. In certain embodiments, pump 50 can be used in conjunction with a reservoir 13 which is pressure balanced to the wellbore pressure at the preselected depth 130. In such embodiments, the pump power is not limited by the hydrostatic pressure head.

It should be appreciated that the power limit of pump 50 is directly related to the piston power and that changing the diameter of the working piston 56 will have a direct effect on piston power. The maximum axial force F exerted by the pumping fluid on pumping piston 57 is shown in the following equation:

$$F = \text{hydraulic pressure} * A \qquad \text{(Equation 1)}$$

where A is the area of the piston 57 when piston 57 is translated all the way to the left end wall within cylinder 54 and the difference between the area of the piston 57 and the connecting rod 58 when piston 57 is translated to a position away from the left end wall of cylinder 54.

The axial force that pump 50 can provide is dependent on the hydraulic limits of the working fluid, the difference between the maximum pumping pressure of the pump and the wellbore pressure ΔP at the preselected depth 130 and the area of working piston 56 as will be more fully described herein below. For a given piston power, and the maximum axial force from Equation 1, the relationship of the speed at which the piston pair 56, 57 move axially, or the stroke speed V, can be expressed as follows:

$$\text{PistonPower} = \Delta PQ = \Delta PA * \text{Speed} = FV \qquad \text{(Equation 2)}$$

The displacement of pump 50 can be referred to as the swept volume or the volume swept by pumping piston 57 of the variable chambers 61, 62. In the embodiment shown, flow rate Q depends from piston power as discussed above and is independent of the displacement of pump 50. The cycle of the pump is the displacement of pumping piston 57 from one end of pumping chamber 62 to the other end and back again. It is important in such an embodiment to control the effects of turnaround in the direction of arrow 63, the manner of control and amount of time between the forward stroke and the return stroke, in order to maintain a substantially constant volumetric flow rate Q throughout the entire cycle of the pump. The time each full stroke takes, or stroke time, is the piston swept volume divided by the volume flowrate flow rate. The volumetric efficiency of pump 50 is also of concern and it is affected by the hydraulic system powering the working piston 57. In this particular embodiment, the volumetric efficiency can be considered to be the ratio of the actual volume of fluid pumped out of variable chambers 61, 62 to the swept volume of the pump 50 described above. In a positive displacement pump 50 of the present disclosure, this ratio is dependent upon the changeover time of the inlet and outlet valves, which in turns depends on such factors as the fluid compressibility, method of valve operation and piston reversal time.

It is within the scope of this disclosure that the volumetric displacement within the pumping bore 54 by the working piston 57 sliding within the cylinder 52 can be changed without changing the hydraulic volumetric displacement of working bore 53. Changing the sizes of piston 57 and cylinder 52, provided that the pumping piston 57 is slidably sealed against the wall of pumping bore 54 as described herein above, will change the volumetric ratio of the fluid pumped out of chamber 62 per stroke of piston 57. This changeable volumetric ratio will allow for the selection of higher pressure fluid drawdown using a smaller diameter piston 57 and cylinder 52, or higher fluid flow rate using a larger diameter piston 57 and cylinder 52. It should be appreciated by those skilled in the art that these changes in volumetric ratio in accordance with this disclosure will remain proportional to the power available to the hydraulic pump introducing the working fluid to working bore 53.

Figure 2:
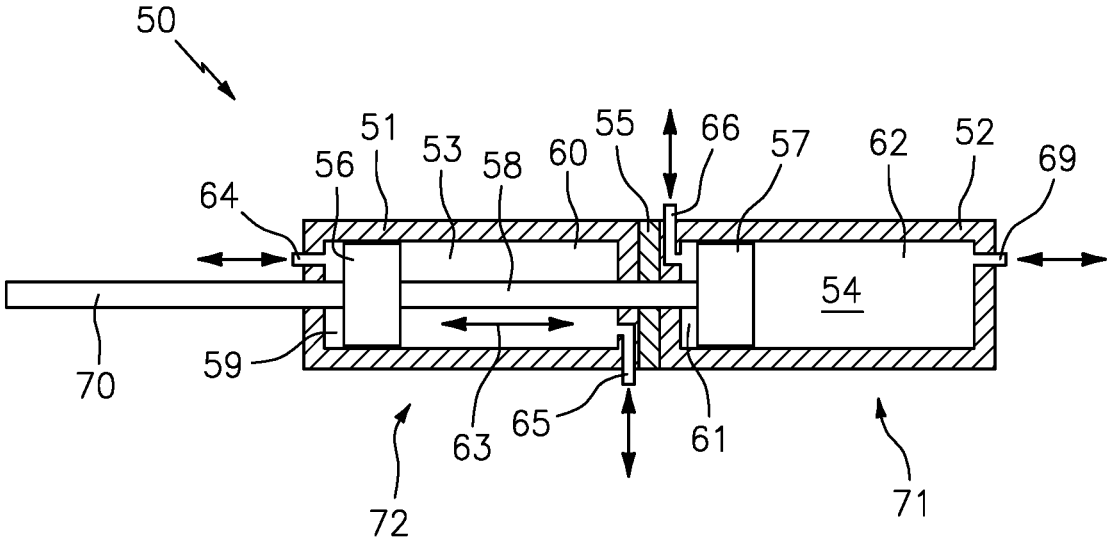
FIG. 2 illustrates a pump for a formation tester in accordance with certain aspects of the present disclosure.

The tandem pump configuration of pump 50 shown FIG. 2 in this embodiment is configurable so that it is possible to change the fluid pumping elements 71 (port 66, pumping bore 54, pumping piston 57, pumping housing 52, and port 69) to change the pumping volumetric ratios as described above without the need to change the working fluid pumping elements 72 (port 64, working housing 51, working piston 56, working chamber 53, and port 65). This ability to change pump ratios provides the capability to configure the pump for higher pressure drawdown or higher volume pump out as required by the reservoir conditions without draining working fluid from chambers 59, 60.

Figure 3:
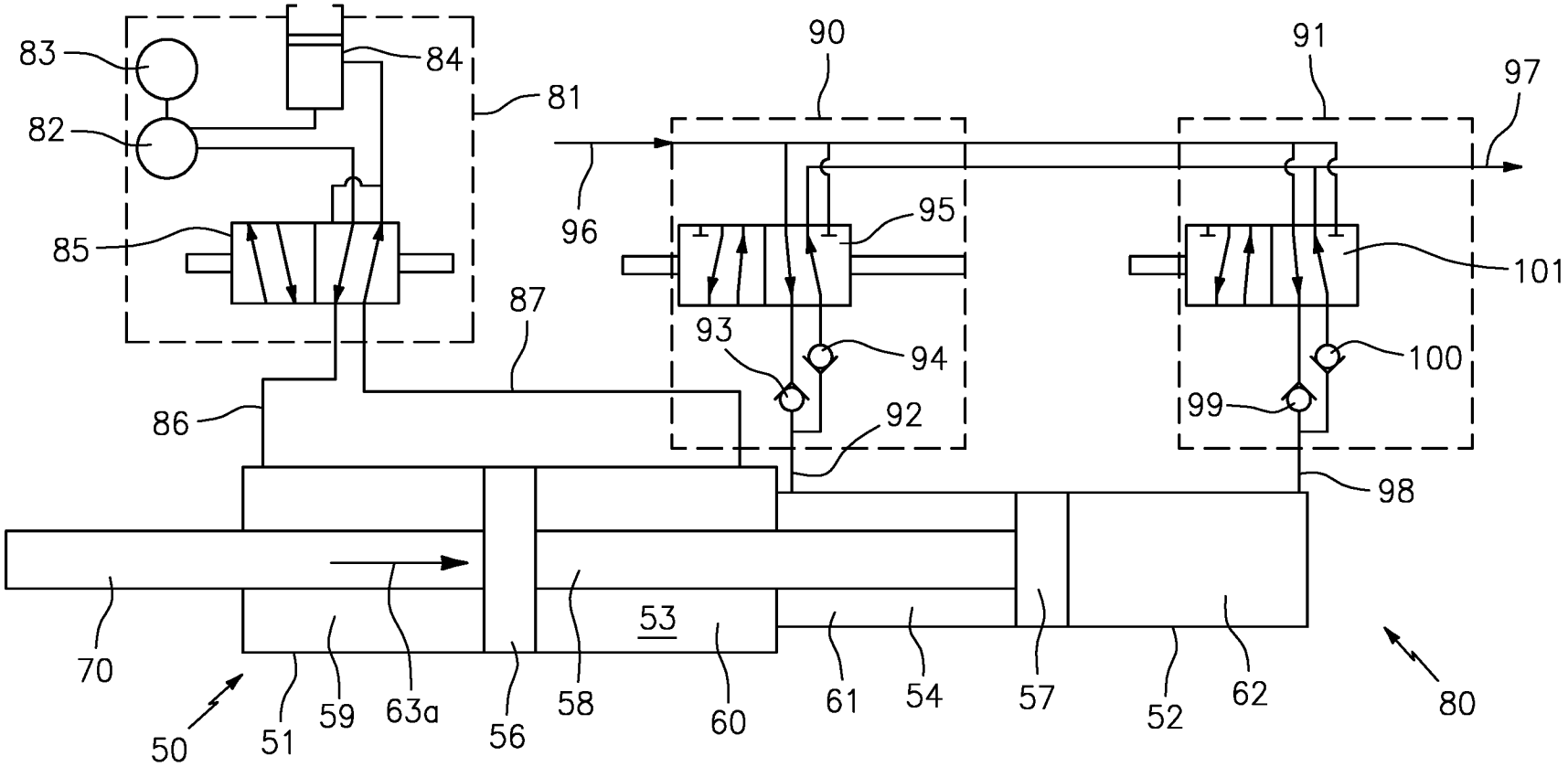
FIG. 3 illustrates a pumping system in a forward stroke pumping uphole in accordance with certain aspects of the present disclosure.

In addition, the tandem pump configuration of pump 50 shown FIG. 2, in certain embodiments within the formation tester 20 (FIG. 1), is configurable so that it is possible to dismantle the fluid pumping elements 71 to clean the fluid pumping elements described above without the need to dismantle the working fluid pumping elements 72 or drain hydraulic oil from the working bore 53 (FIG. 3).

Now referring to FIG. 3, there is shown an embodiment of pumping system 80 comprising a portion of pumping module 31 (FIG. 1). Fluid pumping system 80 includes hydraulic pumping module 81 having pump 82 coupled thereto, and driven thereby, electric motor 83 and further includes working fluid tank 84 equalized tank to well pressure. Pump 82 may be any known hydraulic pump capable of providing sufficient flow and pressure of a working fluid to working chambers 59, 60 through the control of variable speed electric motor 83 and hydraulic module shuttle valve 85. Hydraulic pumping module 81 further includes hydraulic module shuttle valve 85 for selectively pumping hydraulic fluid into and out of chambers 59, 60 via hydraulic lines 86, 87 coupled to hydraulic module ports (not shown) and to translate connecting rod 58 axially in a desired direction. Fluid pumping system 80 also includes valve modules 90, 91 to selectively control the flow of formation fluid into and out of pumping chambers 61, 62 and direct the fluid within the formation tester 20 (FIG. 1). Valve module 90 includes conduit 92 in fluid communication with chamber 61, inlet check valve 93 and outlet check valve 94. Inlet check valve 93 and outlet check valve 94 are in fluid communication with valve module shuttle valve 95 which selectively controls the formation fluid in from the formation/reservoir through valve module port (not shown) indicated by arrow 96 and out of the pump 50 into formation tester 20 though valve module port (not shown) indicated by arrow 97 as will be more fully described herein after. Similarly, valve module 91 includes conduit 98 in fluid communication with chamber 62, inlet check valve 99 and outlet check valve 100. Inlet check valve 99 and outlet check valve 100 are in fluid communication with a second valve module shuttle valve 101 which selectively controls the fluid in from the reservoir indicated by arrow 96 and out of the pump 50 into formation tester 20 indicated by arrow 97.

The operation of pump 50 and fluid pumping system 80 is now described by first referencing FIG. 3 wherein the pump is moving in a forward stroke indicated by arrow 63*a* and pumping fluids uphole in the direction indicated by arrow 97. Such operation would be typical in the cleanup and sampling of reservoir fluids, among other operations. With hydraulic module shuttle valve 85 positioned in a first forward stroke position as shown, pump 82 causes hydraulic working fluid to flow into first working chamber 59 via hydraulic line 86 and exerting hydraulic pressure against piston 56 moving pistons 56, 57 in the forward stroke direction and causing the volumes of first working fluid chamber 59, second working fluid chamber 60 and first formation fluid chamber 61, and second formation fluid chamber 62 to change in a proportional manner. At the same time, hydraulic fluid is exhausted from first working chamber 60 through hydraulic line 87, hydraulic module shuttle valve 85 and into working fluid tank 84 which can be pressure equalized to wellbore pressure. As formation fluid pumping piston 57 moves in the forward stroke direction indicated by arrow 63*a* reservoir fluid is drawn into valve module 90 through valve module shuttle valve 95, check valve 93 and conduit 92 thereby filling first pumping chamber 61. Both shuttle valves 95, 101 are positioned in a first uphole pumping configuration as shown. Concurrently, reservoir fluid is exhausted from, or pumped out of, pumping chamber 62 by the movement of pumping piston 57 in the forward stroke direction 63*a*. Reservoir fluid exits pumping chamber 62 via conduit 98 through check valve 100 and, with valve module shuttle valve 101 positioned as shown, the reservoir fluid is pumped into formation tester 20 (FIG. 1) in the uphole direction. It should be appreciated that at the end of the forward stroke pistons 56, 57 will be positioned against an end wall of their respective housings 51, 52 such that there is substantially no "dead space" between piston 56 and the end wall of housing 51 and that variable volume chamber 59 is at 100% and variable volume chamber 60 is at 0% capacity. It should be further appreciated that in the embodiment shown that, at the end of the forward stroke, there is substantially no "dead space" between piston 57 and the end wall of housing 52 and that variable volume chamber 61 is at 100% and variable volume chamber 62 is at 0% capacity. In other words, the entire per stroke volume of pump 50 has been exhausted and chamber 61 of pumping bore 54 is full of reservoir fluid and at the pump's maximum forward stroke volume.

Figure 4:
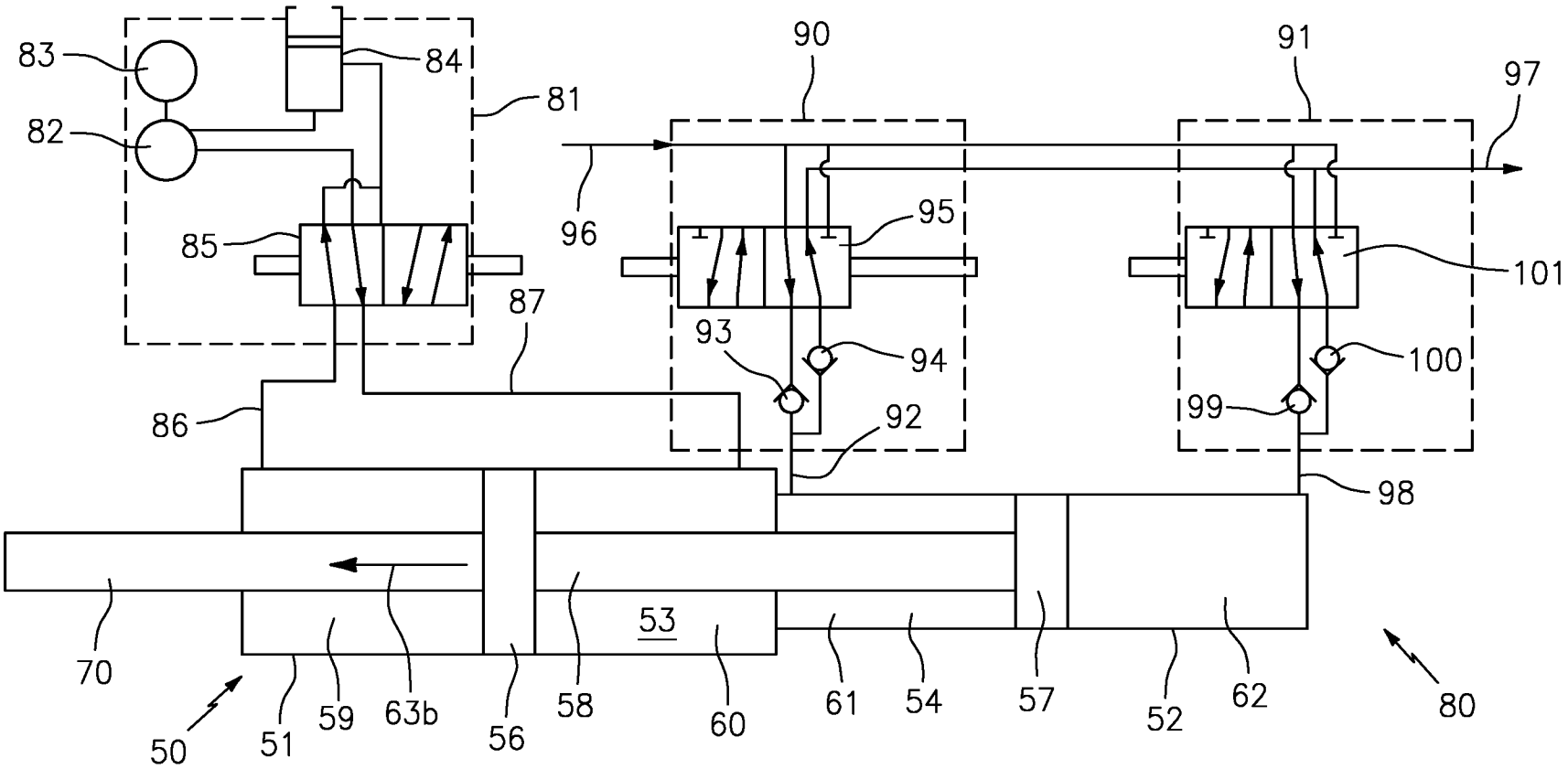
FIG. 4 illustrates a pumping system in a return stroke pumping uphole in accordance with certain aspects of the present disclosure.

Now referring to FIG. 4, the operation of pump 50 will be described with the pistons 56, 57 and connecting rod 58 moving axially in a return stroke direction indicated by arrow 63*b* and pumping fluids uphole in the direction indicated by arrow 97. With hydraulic module shuttle valve 85 positioned in a return stroke position as shown, pump 82 causes hydraulic fluid to flow into first working chamber 60 via hydraulic line 87 and exerting hydraulic pressure against the right hand side of piston 56 moving pistons 56, 57 and connecting rod 58 in the return stroke direction 63*b* and causing the volumes of chambers 59, 60 and chambers 61, 62 to change in a proportional manner. At the same time, working fluid is exhausted from first working chamber 60 through hydraulic line 86, hydraulic module shuttle valve 85 and into working fluid tank 84. As pumping piston 57 moves in the return stroke direction 63*b*, reservoir fluid is drawn into valve module 91 indicated by arrow 97 through valve module shuttle valve 101, check valve 99 and conduit 98 thereby filling formation fluid pumping chamber 62. Concurrently, reservoir fluid is exhausted from, or pumped out of, first pumping chamber 61 by the movement of pumping piston 57 in the return stroke direction 63*b*. Reservoir fluid exits first pumping chamber 61 via conduit 92 through check valve 94 and, with valve module shuttle valve 95 positioned as shown, the reservoir fluid is pumped into formation tester 20 (FIG. 1) in the uphole direction. At the end of the return stroke, pistons 56, 57 will be positioned against an end wall of their respective housings 51, 52 such that there is substantially no "dead space" between piston 56 and the end wall of housing 51 and that variable volume chamber 59 is at 0% and variable volume chamber 60 is at 100% capacity. At the end of the return stroke, there is substantially no "dead space" between piston 57 and the end wall of housing 52 and that variable volume chamber 61 is at 0% and variable volume chamber 62 is at 100% capacity and at the pump 50 maximum return stroke volume. It should be further noted that the return stroke pumping volume of first formation fluid chamber 61 differs from the forward stroke pumping volume of second formation fluid chamber 62 (FIG. 3) by the volume that is taken up by connecting rod 58 during the return stroke. As described herein above, variable speed motor 83 is controlled in order to maintain a constant flow rate Q.

Figure 5:
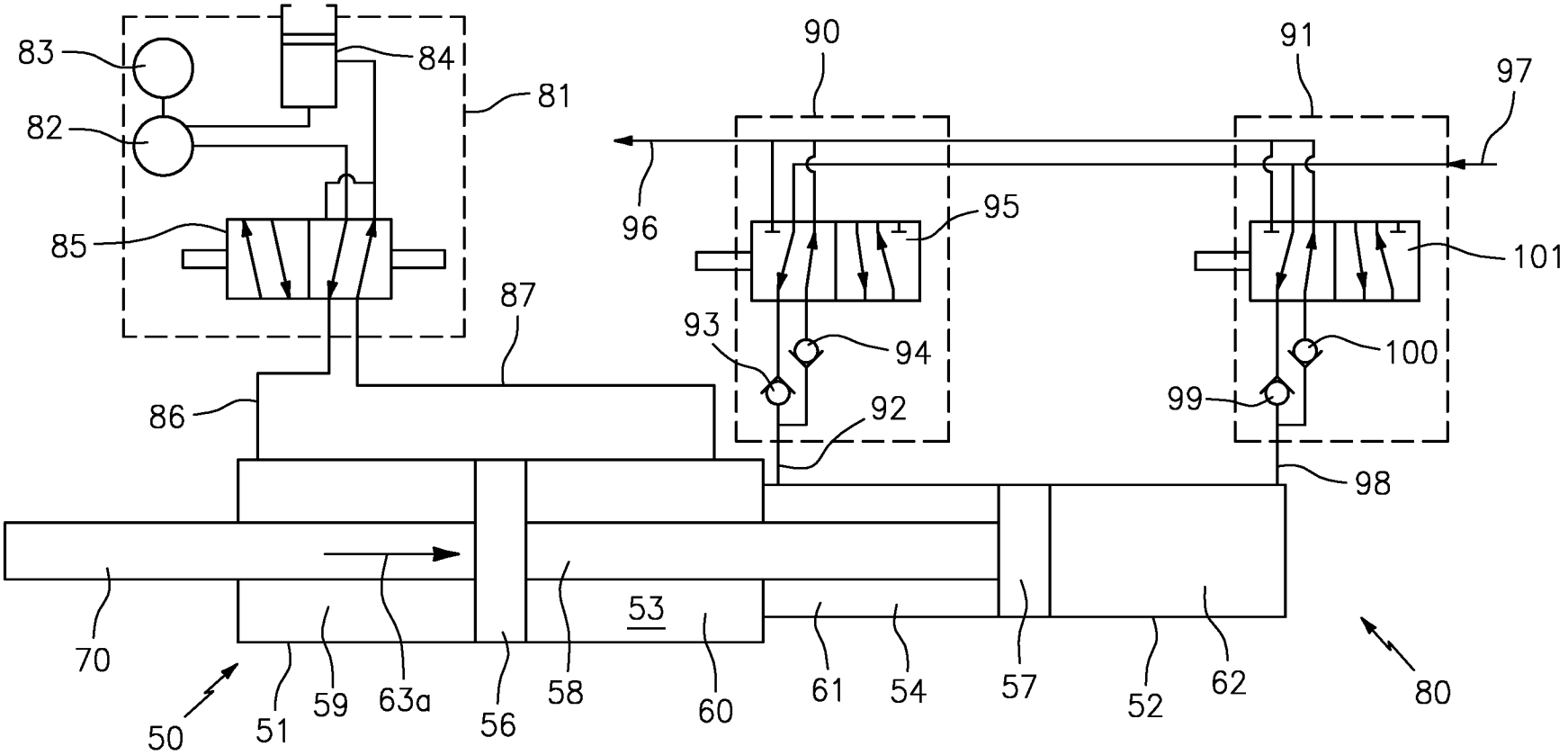
FIG. 5 illustrates a pumping system in a forward stroke pumping downhole in accordance with certain aspects of the present disclosure.
Figure 6:
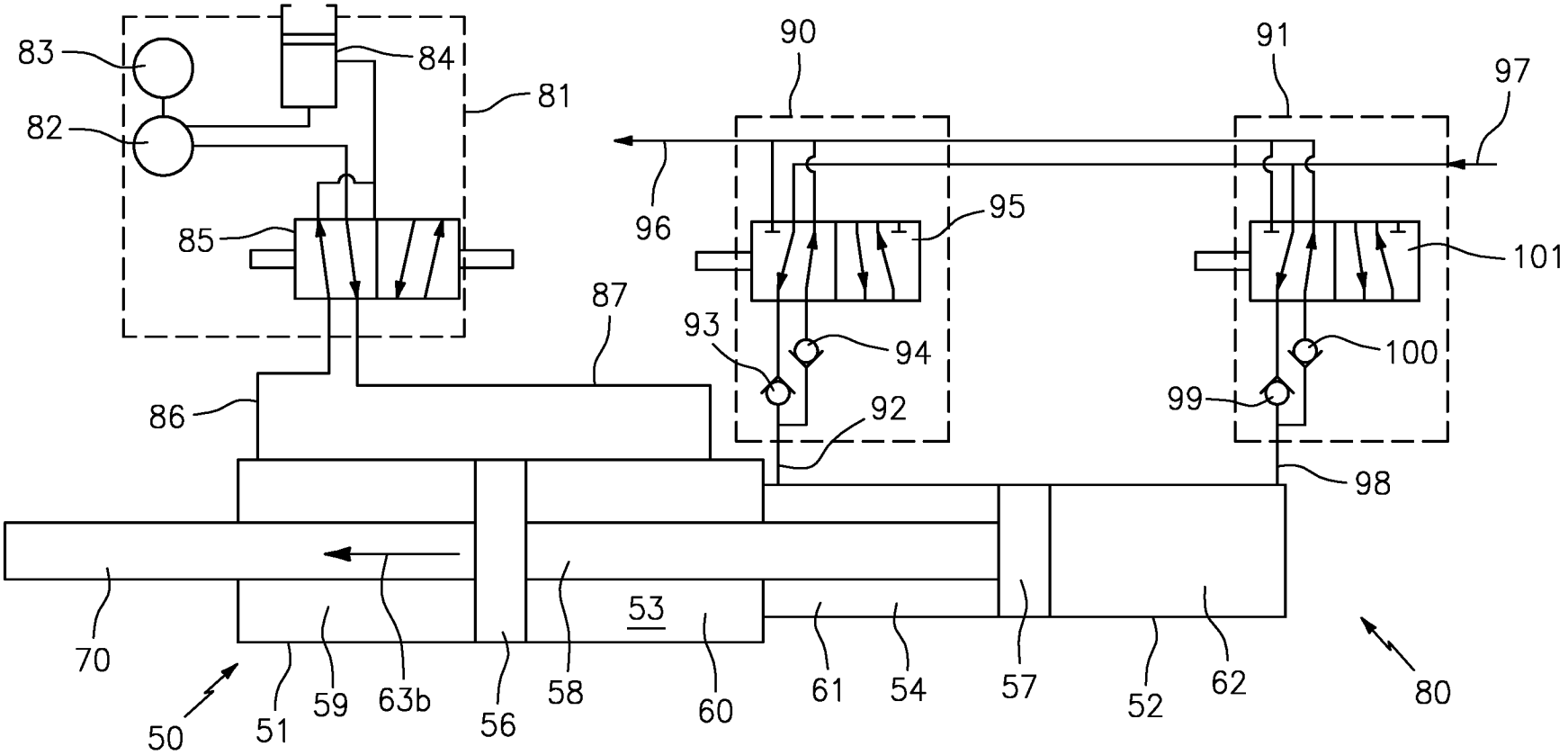
FIG. 6 illustrates a pumping system in a return stroke pumping downhole in accordance with certain aspects of the present disclosure.

As discussed herein before, pump 50 can be configured to pump fluids in the opposite direction, i.e. the downhole direction opposite of arrow 96, for certain operations such as injecting fluids into the formation, unclogging hydraulic lines or the probe and the like. The operation of fluid pumping system 80 to pump fluids in the downhole direction in the forward pumping stroke is best described with reference to FIG. 5. In the embodiment shown in FIG. 5, the operation of the fluid pumping system 80 is the same as the forward pumping stroke while pumping uphole as described with reference to FIG. 3 with the exception of the positions of shuttle valves 95, 101 wherein both shuttle valves are positioned in a downhole pumping configuration. In the embodiment shown, pumping piston 57 moves in the forward stroke direction indicated by arrow 63*a* and injecting fluid is drawn into valve module 90 from the uphole direction indicated by arrow 97 through valve module shuttle valve 95, check valve 93 and conduit 92 thereby filling first pumping chamber 61. Concurrently, injecting fluid is exhausted from, or pumped out of, pumping chamber 62 by the movement of pumping piston 57 in the forward stroke direction 63*a*. The fluid exits pumping chamber 62 via conduit 98 through check valve 100 and, with valve module shuttle valve 101 positioned as shown, the fluid is pumped out of formation tester 20 (FIG. 1) in the downhole direction and into the formation indicated by arrow 96. Now referring to FIG. 6 there is shown an embodiment of the present disclosure wherein injecting fluids are pumped downhole during the return stroke of the working piston 57 of pump 50. As pumping piston 57 moves in the return stroke direction indicated by arrow 63*b*, fluid is drawn into valve module 91 from the uphole direction indicated by arrow 97, through valve module shuttle valve 101 positioned in the second downhole pumping configuration, check valve 99 and conduit 98 thereby filling pumping chamber 62. Concurrently, the injecting fluid is pumped out of first pumping chamber 61 by the movement of pumping piston 57 in the return stroke direction 63*b*. The injecting fluid exits first pumping chamber 61 via conduit 92 through check valve 94 and, with valve module shuttle valve 95 positioned in the second downhole pumping configuration as shown, the fluid is pumped out of formation tester 20 (FIG. 1) in the downhole direction indicated by arrow 96 and into the formation 13.

While the foregoing is directed to embodiments of the present invention, other and further embodiments of the invention may be devised without departing from the basic scope thereof, and the scope thereof is determined by the claims that follow.

What is claimed is:

1. A fluid pumping system, comprising:

a housing having a first cylinder and a second cylinder in axial alignment positioned therein;

a working piston slidably positioned in the first cylinder and a pumping piston slidably positioned in the second cylinder;

a connecting rod axially connecting the working piston to the pumping piston and sealably isolating the first cylinder from the second cylinder;

wherein the working piston forms a first working chamber and a second working chamber in the first cylinder;

wherein the pumping piston forms a first pumping chamber and a second pumping chamber in the second cylinder;

a motor driven pump adapted to forcibly pump a working fluid into and out of the first working chamber and into and out of the second working chamber to produce an axial force on the connecting rod;

wherein the first working chamber and the second working chamber are configured to be in fluid communication with the working fluid and the first pumping chamber and the second pumping chamber are configured to be in fluid communication with a process fluid;

a first working port positioned in the first working chamber configured to be in fluid communication with the working fluid;

a second working port positioned in the second working chamber configured to be in fluid communication with the working fluid;

a first pumping port positioned in the first pumping chamber configured to be in fluid communication with the process fluid; and a second pumping port positioned in the second pumping chamber configured to be in fluid communication with the process fluid;

a first working valve positioned in the first working port, a second working valve positioned in the second working port, a first pumping valve positioned in the first pumping port and a second pumping valve positioned in the second pumping port;

a working piston seal positioned on an outer diameter of the working piston to fluidically seal the first working chamber from the second working chamber;

a pumping piston seal positioned on an outer diameter of the pumping piston to fluidically seal the first pumping chamber from the second pumping chamber;

a hydraulic pumping module including the motor driven pump coupled to the first working valve and configured to selectively pump the working fluid into and out the first working chamber and coupled to the second working valve and configured to selectively pump the working fluid into and out of the second working chamber;

a first valve module coupled to the first pumping valve and configured to selectively allow the process fluid into and out of the first pumping valve;

a second valve module coupled to the second pumping valve and configured to selectively allow the process fluid into and out of the second pumping valve;

wherein the hydraulic pumping module further comprises:

a working fluid tank;

the motor driven pump in fluid communication with the working fluid tank; and a hydraulic pumping module shuttle valve selectively fluidically coupled to the working fluid tank, the pump, the first working valve and the second working valve.

2. The fluid pumping system of claim 1, further comprising a displacement rod connected to the working piston and slidably sealing the first working chamber from an outside portion of the first cylinder.

3. The fluid pumping system of claim 1, wherein the outer diameter of the working piston is larger than the outer diameter of the pumping piston.

4. The fluid pumping system of claim 1 wherein the outer diameter of the working piston is equal to the outer diameter of the pumping piston.

5. The fluid pumping system of claim 1 wherein the working fluid comprises any of a mineral oil, a drilling mud, and a water.

6. The fluid pumping system of claim 1 wherein the process fluid comprises any of a drilling mud, a filtrate, a reservoir fluid, and an injection fluid.

7. A fluid pumping system, comprising:

a housing having a first cylinder and a second cylinder in axial alignment positioned therein;

a working piston slidably positioned in the first cylinder and a pumping piston slidably positioned in the second cylinder;

a connecting rod axially connecting the working piston to the pumping piston and sealably isolating the first cylinder from the second cylinder;

wherein the working piston forms a first working chamber and a second working chamber in the first cylinder;

wherein the pumping piston forms a first pumping chamber and a second pumping chamber in the second cylinder;

a motor driven pump adapted to forcibly pump a working fluid into and out of the first working chamber and into and out of the second working chamber to produce an axial force on the connecting rod;

wherein the first working chamber and the second working chamber are configured to be in fluid communication with the working fluid and the first pumping chamber and the second pumping chamber are configured to be in fluid communication with a process fluid;

a first working port positioned in the first working chamber configured to be in fluid communication with the working fluid;

a second working port positioned in the second working chamber configured to be in fluid communication with the working fluid;

a first pumping port positioned in the first pumping chamber configured to be in fluid communication with the process fluid; and a second pumping port positioned in the second pumping chamber configured to be in fluid communication with the process fluid;

a first working valve positioned in the first working port, a second working valve positioned in the second working port, a first pumping valve positioned in the first pumping port and a second pumping valve positioned in the second pumping port;

a working piston seal positioned on an outer diameter of the working piston to fluidically seal the first working chamber from the second working chamber;

a pumping piston seal positioned on an outer diameter of the pumping piston to fluidically seal the first pumping chamber from the second pumping chamber;

a hydraulic pumping module including the motor driven pump coupled to the first working valve and configured to selectively pump the working fluid into and out the first working chamber and coupled to the second working valve and configured to selectively pump the working fluid into and out of the second working chamber;

a first valve module coupled to the first pumping valve and configured to selectively allow the process fluid into and out of the first pumping valve;

a second valve module coupled to the second pumping valve and configured to selectively allow the process fluid into and out of the second pumping valve; and wherein the first valve module comprises:

a first valve module port;

a second valve module port;

a third valve module port; and a first valve module shuttle valve selectively fluidically coupled to the first valve module port, the second valve module port, the third valve module port and the first pumping port;

the second valve module comprises:

a fourth valve module port;

a fifth valve module port;

a sixth valve module port; and a second valve module shuttle valve selectively fluidically coupled to the fourth valve module port, the fifth valve module port, the sixth valve module port and the first pumping port;

the second valve module port is fluidically coupled to the fourth valve module port; and the third valve module port is fluidically coupled to the fifth valve module port.

* * * * *